US005297600A

United States Patent [19]

Downes et al.

[11] Patent Number: 5,297,600

[45] Date of Patent: Mar. 29, 1994

[54] CONTAINER EMPTYING DEVICE

[76] Inventors: Kenneth V. Downes, 2619 Potsprings Rd., Timonium, Md. 21093; Michael R. Reitz, 2124 Corbin Rd., Baltimore, Md. 21214; Frances S. Downes, 4133 Edinburgh Dr., Virginia Beach, Va. 23452

[21] Appl. No.: 4,052

[22] Filed: Jan. 13, 1993

[51] Int. Cl.[5] ..... B65B 1/04; B65B 3/00; B67C 3/00

[52] U.S. Cl. ..... 141/364; 141/106; 141/375

[58] Field of Search ..... 141/363, 364, 365, 366, 141/375, 106; 248/146, 311.3, 205.5, 206.3, 206.4, 205.2; 211/75

[56] References Cited

U.S. PATENT DOCUMENTS

| | | | |
|---|---|---|---|
| 1,335,369 | 3/1920 | Donohue | 211/75 |
| 2,508,945 | 5/1950 | Hever | 211/75 |
| 2,536,419 | 1/1951 | Brunell et al. | 141/341 |
| 2,780,081 | 2/1957 | Alexander | 141/363 |
| 3,286,849 | 11/1966 | Dominos | 141/106 |
| 4,217,941 | 8/1980 | Catalano | 141/375 |
| 4,271,878 | 6/1981 | Bologa | 141/375 |
| 4,399,847 | 8/1983 | McRoberts | 141/364 |
| 4,454,897 | 6/1984 | Valiant | 141/364 |
| 4,648,572 | 3/1987 | Sokol | 248/205.2 |
| 4,984,693 | 1/1991 | Belokin, Jr. et al. | 248/206.3 |
| 5,080,150 | 1/1992 | Deadwyler, Jr. | 141/106 |
| 5,105,860 | 4/1992 | Connor | 141/106 |

*Primary Examiner*—Henry J. Recla
*Assistant Examiner*—Steven O. Douglas
*Attorney, Agent, or Firm*—Walter G. Finch

[57] ABSTRACT

A device is provided for emptying bottles containing semi-viscous fluids. It consists of a base member, an upper member having a recess, a resiliently flexible sleeve contained within said recess of said upper member, and a plurality of vertical supports connecting said upper member to said base member. In another embodiment of the invention the device is intended to be suspended on a wall which comprises an upper member having a recess, a resiliently flexible sleeve contained within said recess of said upper member, a rear plate running perpendicular to said upper member and joined to said upper member at its rearmost point, and a multiplicity of diagonal support members connecting said upper member to said rear plate. Both embodiments of the invention receive an inverted bottle in a resiliently flexible sleeve member capable to suspending the inverted bottle until it gravity drains its contents into a cup. Means for additional lateral support is provided to the inverted bottle by either a rotating locking member or a scissoring locking member.

7 Claims, 6 Drawing Sheets

CONTAINER EMPTYING DEVICE

This invention relates to improvements in apparatus used to empty containers of various types, including bottles containing semi-viscous fluids, and more particularly it pertains to improvements in bottle emptying devices which are economical to manufacture, easily storable, and clean in operational use.

BEST KNOWN PRIOR ART

The best known prior U.S. art is as follows:

U.S. Pat. No. 2,536,419
U.S. Pat. No. 4,217,941
U.S. Pat. No. 4,271,878
U.S. Pat. No. 4,399,847
U.S. Pat. No. 4,454,897
U.S. Pat. No. 5,080,150
U.S. Pat. No. 5,105,860

Over time, people have been frustrated at the amount of time it takes to completely empty containers such as bottles containing certain semi-viscous fluids. Perhaps the most frustrating of all is the infamous ketchup bottle. For years, youths as well as adults have frantically smacked the bottoms of these ketchup bottles only to wind up with lots of bruises on their hands but little ketchup on their food.

Restaurant owners, realizing the waste in throwing away bottles of ketchup (as well as bottles of mustard and other condiments) which are not completely empty, have struggled to hold onto their profits by consolidating the contents of these hard-to-empty bottles. Given this dilemma, the prior art does in fact include numerous inventions directed solely at emptying one ketchup bottle into another.

The Valiant U.S. Pat. No. 4,454,897 teaches a holder which, when used in conjunction with a connecting band, forms an hour-glass shaped configuration in which the two ketchup bottles are inserted into opposite ends. Subsequently, the contents of one are allowed to gravity drain into the other. U.S. Pat. No. 4,217,941 issued to Catalano discusses a ketchup rapping apparatus in which one bottle may be inverted 180 degrees over top of another adjacent bottle and then be gravity drained. Additionally, through the use of shock absorbing pads, the Catalano device allows the top bottle to be rapped without danger of chipping either bottle.

Few people besides restaurant owners try to place the contents of one bottle into another. Fortunately, there are also devices in the art which do not attempt to consolidate the contents of nearly empty bottles, but rather try to empty them into another container. Unfortunately, these devices seem to suffer from the drawback that they are messy to use, that they only accept round bottles, or that they don't provide proper lateral support for the draining bottle.

The Connor U.S. Pat. No. 5,105,860 is one such device whereby an apparatus for draining bottles of various cap sizes is discussed. A bottleholder containing an upper ring to hold the bottle and a lower funnel to guide the draining fluid is the subject of the Brunell U.S. Pat. No. 2,536,419.

U.S. Pat. No. 4,399,847 issued to McRoberts uses a slender member inserted into the emptying bottle to suspend the bottle as it drains. While all three of these inventions do facilitate emptying of the bottles, all three are extremely messy to use. The block of the Connor patent, the slender member of the McRoberts patent, and the funnel of the Brunell patent all become soiled in the course of operation. Consequently, all three need to be washed thoroughly in between each use.

The U.S. Pat. No. 4,271,878 issued to Bologa includes an upper portion for receiving the neck of an inverted bottle for emptying. In the patent, a number of fingers extend inward and support the bottle while it is emptying. Yet, a major drawback with the Bologa invention is that it only works on round bottles. Further, it seems somewhat messy to be inserting and retracting an emptying bottle vertically into and out of a support.

The Deadwyler, Jr. U.S. Pat. No. 5,080,150 supports a bottle in an inverted position while the bottle still has its lid on. The liquid thus moves into the neck of the bottle. Consequently, no liquid transfer out of the bottle is achieved by the device. Additionally, the final transfer of certain viscous fluids such as ketchup out from the necks of their containers takes relatively large amounts of time. Finally, the Deadwyler, Jr. patent does not appear to give adequate lateral support to long or heavy bottles. Consequently, tipping of such bottles appears very possible.

OBJECTS OF THE INVENTION

It is therefore the primary object of this invention to provide a device for emptying bottles containing semi-viscous fluids which is simple in construction and easy to use.

It is a further object of this invention to provide a novel bottle emptying device made from plastic and rubber which will help recover the final portions of thick fluids contained within bottles.

Still another object of this invention is to provide a unique and novel bottle emptying device which minimizes the amount of mess incurred before, during, and after emptying.

To provide a unique bottle emptying device which accepts bottles of various sizes and geometries is still another object of this invention.

To provide a device for emptying semi-viscous fluid containing bottles which incorporates locking mechanisms to provide additional lateral support for the draining bottle is still another object of this invention.

To provide a novel bottle emptying device which incorporates vertical supports which are inwardly collapsible is yet another object of this invention.

And to provide a device for emptying bottles which may be suspended on a wall by means of suction cups or a Velcro pad are still other objects of this invention.

BRIEF DESCRIPTION OF THE DRAWINGS

These and other attendant advantages of this invention will become more obvious and apparent from the following detailed specification and accompanying drawings in which.

DESCRIPTION OF THE PREFERRED EMBODIMENTS OF THE INVENTION

Figure 1:
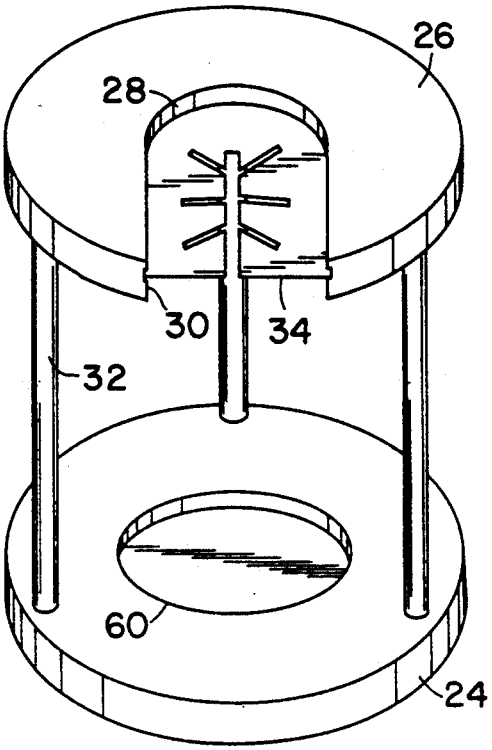
FIG. 1 is a front perspective view of a device for emptying bottles containing semi-viscous fluids and incorporating novel features of this invention.

Referring now to FIGS. 1 to 21 of the drawings, there is shown the preferred embodiment of a bottle emptying device. The device of FIG. 1 comprises a base member 24, an upper member 26 having a recess 28, three vertical members 32 connecting the upper member 26 to the base member 24, and a rubber sleeve 34 contained within a groove 30 in the recess 28 of the upper member 26. The base member 24 has a round indentation 60 in the center of its top surface.

Figure 8:
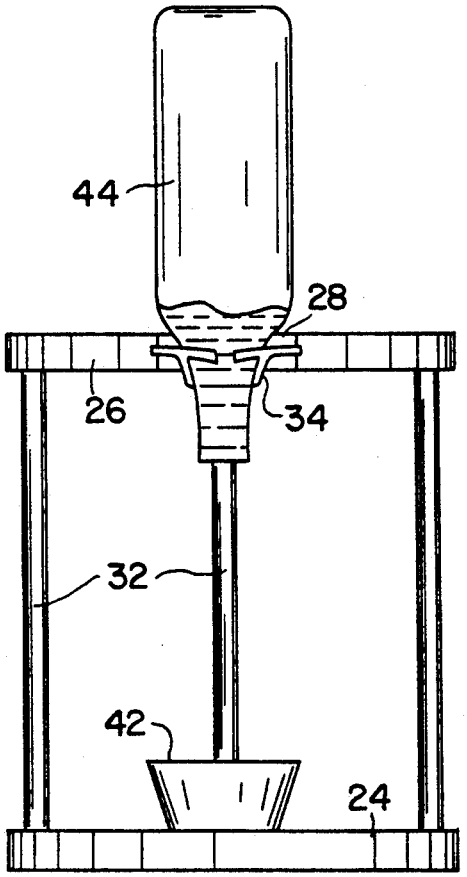
FIG. 8 is a front view of an inverted bottle held within the device of FIG. 1, the contents therein allowed to drain into the cup of FIG. 7.

In operational use, as depicted in FIG. 8, the device is used to support an inverted bottle 44. The bottle 44 is inserted into a number of slits cut into the length of the rubber sleeve 34. The rubber sleeve 34 is of sufficient strength and resilience to support the inverted bottle 44 for an indefinite period of time. During this period of time, the semi-viscous fluid contained within the bottle 44 is allowed to drain into a cup 42 placed in the round indentation 60 in the base member 24. Having the cup 42 sit in the indentation 60 assures proper and accurate draining.

The rubber sleeve 34 contained within the recess 28 can hold bottles of all sizes and geometries, including oblong-sectioned shampoo bottles. Hence, the invention does not tie itself down to only round ketchup bottles. Also, since the neck of the bottle may be slid forward into the slits of the rubber sleeve 34 rather than inserted in a downward fashion, the corresponding mess from the emptying bottle 44 to the device is minimized. Yet, some amount of mess on the rubber sleeve 34 is inevitable. In order to render the invention easily cleanable, the rubber sleeve 34 may be readily slid out from the groove 30 in the recess 28 in order to be washed. In case the rubber sleeve 34 becomes damaged with age or use, it may likewise be replaced.

Figure 2:
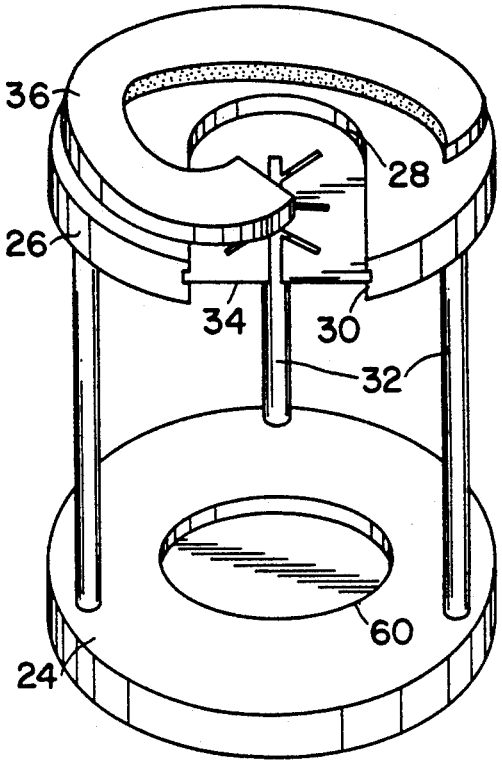
FIG. 2 is a front perspective view of the device for emptying bottles containing semi-viscous fluids of FIG. 1, and including a rotating locking member.
Figure 3:
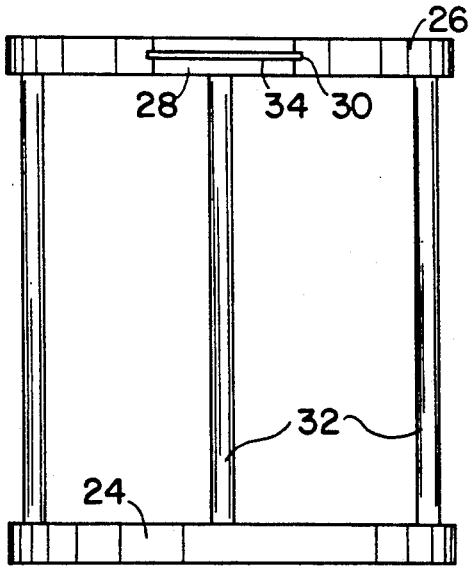
FIG. 3 is a front view of the bottle emptying device of FIG. 1.
Figure 4:
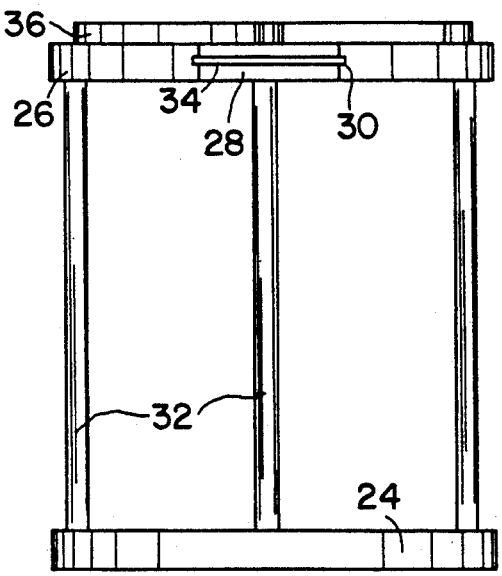
FIG. 4 is a front view of the bottle emptying device of FIG. 2.

Sometimes, extremely heavy or abnormally long bottles may need to be drained. Other times, the device may accidentally be bumped by a human or a pet, or be vibrated by a closing refrigerator door. In these cases, additional lateral support on the bottle would be advantageous since it would decrease the chances of the bottle tipping. FIG. 2 illustrates the same concept previously described with an additional rotating locking member 36. This member 36 is fixed to a curved path cut into the top surface of the upper member 26 and rotates about a point. The rotating locking member 36 may be joined to a path cut in the upper member 26 by means of two or more dowels.

Figure 9:
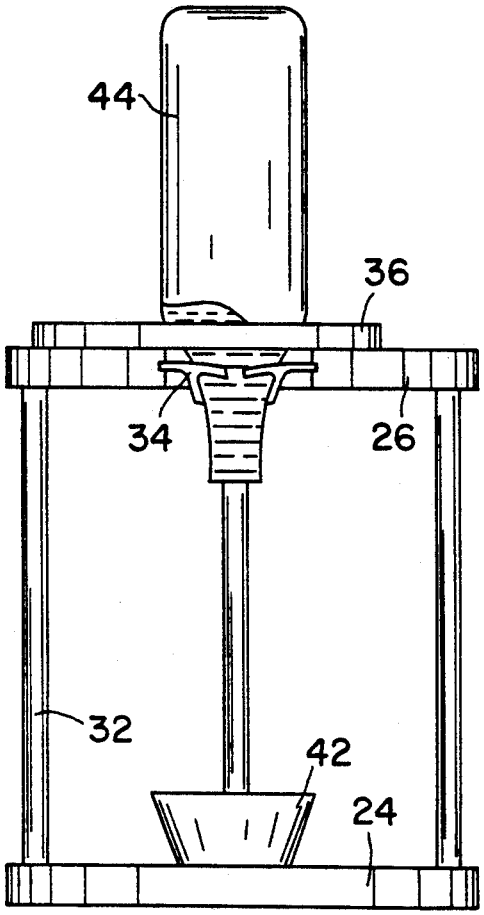
FIG. 9 is a front view of an inverted bottle held within the device of FIG. 2, the contents therein allowed to drain into the cup of FIG. 7.
Figure 11:
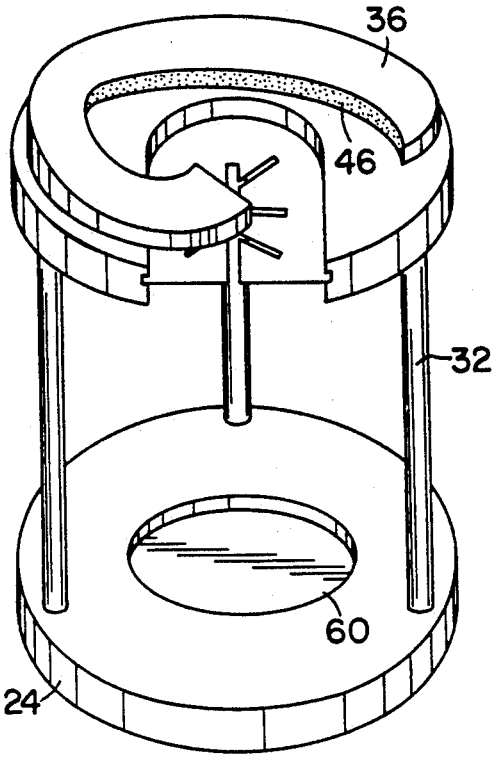
FIG. 11 is a front perspective view of the device of FIG. 2 wherein the rotating locking member has a soft inner surface.

FIG. 9 illustrates this concept. In operational use, the bottle 44 would first be inserted into the slits of the rubber sleeve 34. The rotating locking member 36 would then rotate around the inverted bottle 44 until a point on its curved inner surface made contact with the bottle 44. The contents of the bottle 44 would then drain, as before, into a cup 42. This time, however, the bottle 44 would receive greater lateral support than before and the chances of it tipping would be reduced. Having the inner surface of the rotating locking member 36 coated with a flexible material such as rubber would assist in its grabbing onto the inverted bottle 44. This soft inner surface 46 is seen in FIG. 11.

Figure 5:
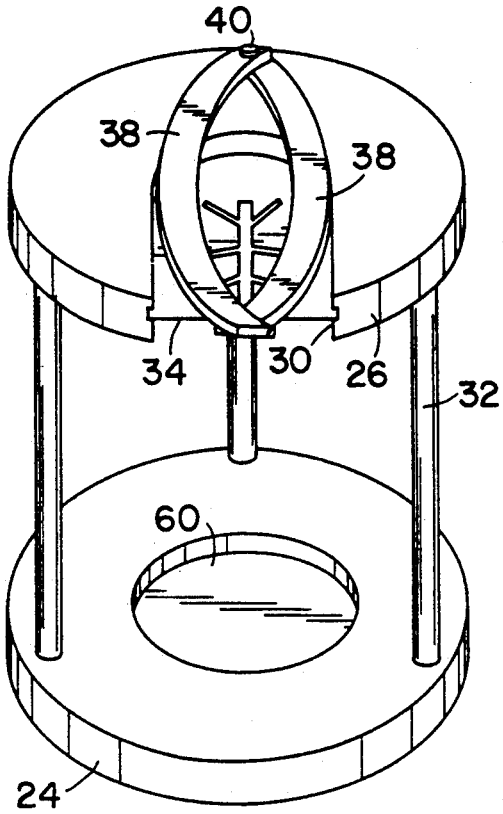
FIG. 5 is a front perspective view of the device for emptying bottles containing semi-viscous fluids of FIG. 1, and including a scissoring locking mechanism.
Figure 6:
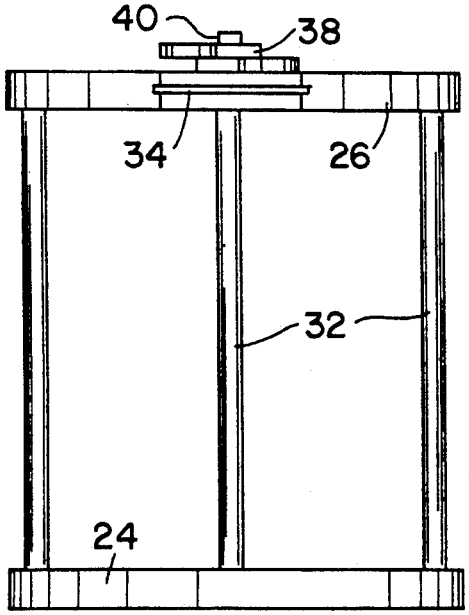
FIG. 6 is a front view of the bottle emptying device of FIG. 5.
Figure 7:
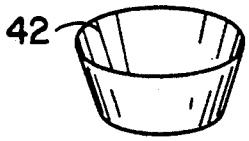
FIG. 7 is a front perspective view of a cup.
Figure 10:
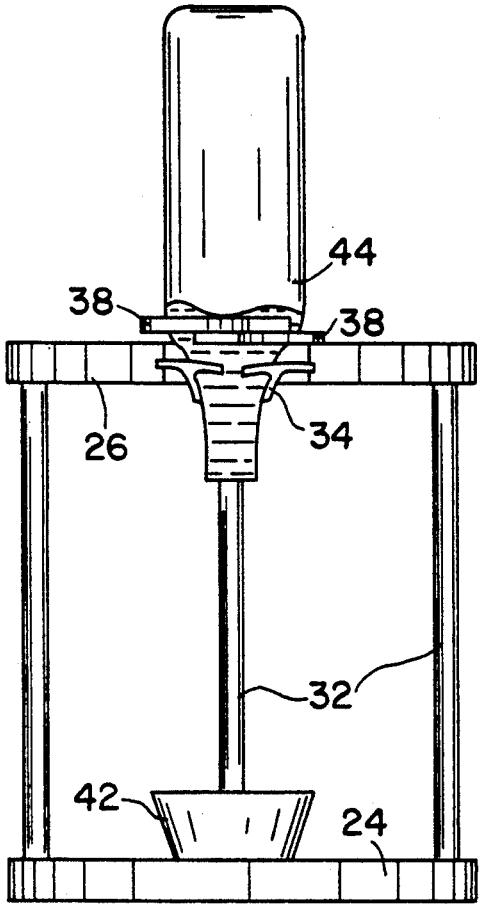
FIG. 10 is a front view of an inverted bottle held within the device of FIG. 5, the contents therein allowed to drain into the cup of FIG. 7.

Alternatively, the device could incorporate a scissoring locking mechanism to provide additional lateral support to the draining bottle 44. As seen in FIG. 5, this scissoring mechanism consists of two inwardly curved blades 38 joined to the top surface of the upper member 26 by a pin 40. Operation, as depicted in FIG. 10, would be very similar to that of the device incorporating the rotating locking member 36.

First, the bottle 44 would be inserted into the slits of the rubber sleeve 34. Next, the inwardly curved blades 38 would be pivoted about the pin 40 in a converging fashion until they each individually engaged the inverted bottle 44 with their inner surfaces. As with the rotating locking member 36, having the inner surfaces of the inwardly curved blades 38 coated with a flexible material such as rubber would assist in their grabbing onto the inverted bottle 44.

Figure 12:
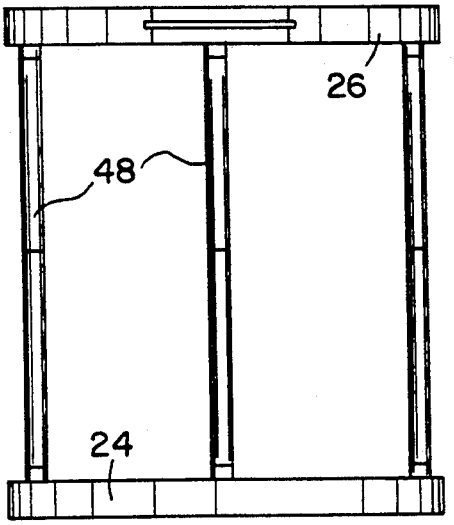
FIG. 12 is a front view of the bottle emptying device of FIG. 1 wherein the vertical supports are hinged to be able to collapse inwardly.
Figure 13:
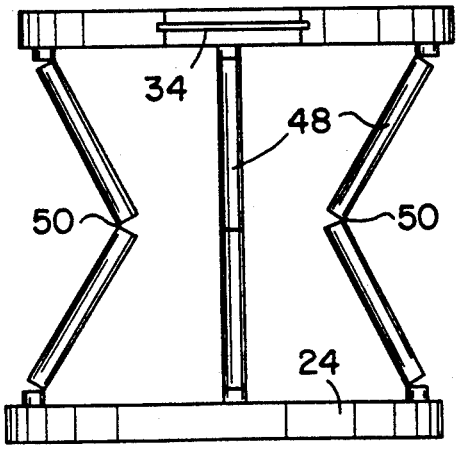
FIG. 13 is a front view of the bottle emptying device of FIG. 12 whereby the vertical supports are starting to collapse inwardly.

The device is seen as extremely useful in the kitchen of a home. Yet, as in most homes, kitchens are constrained in that they have a very limited amount of storage space. Consequently, the device was provided with collapsible vertical members 48 which are able to fold inwardly. This is illustrated in FIGS. 12 and 13. When the device is not in use, the collapsible vertical members 48 may be folded inwardly by means of hinged joints 50 so that the device, in a compact state, may be easily and readily stored.

Figure 14:
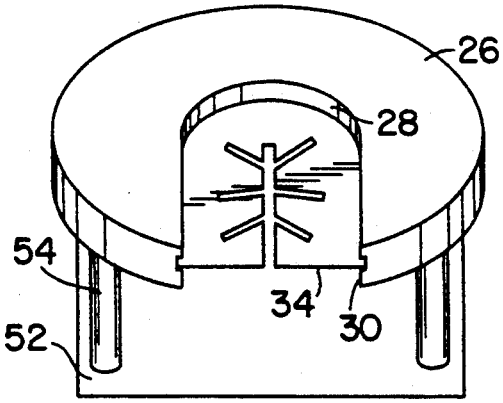
FIG. 14 is a front perspective view of a device for emptying bottles containing semi-viscous fluids and incorporating novel features of this invention.
Figure 15:
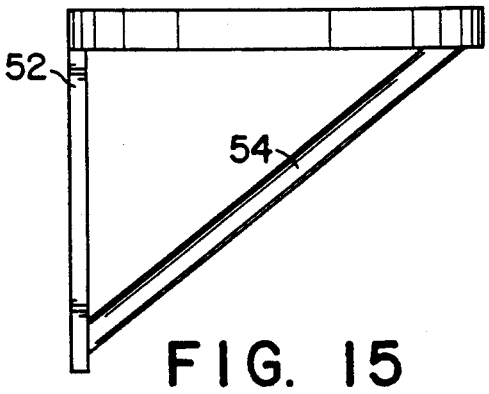
FIG. 15 is a left side view of the bottle emptying device of FIG. 14.

FIG. 14 introduces another embodiment of the bottle emptying device, comprising, an upper member 26 having a recess 28, a rear plate 52 running perpendicular to the upper member 26 and joined to the upper member 26 at its rear most point, two diagonal support members 54 connecting the upper member 26 to the rear plate 52, and a rubber sleeve 34 contained within a groove 30 in the recess 28 of the upper member 26. FIG. 15 shows the left side view of the same.

Figure 20:
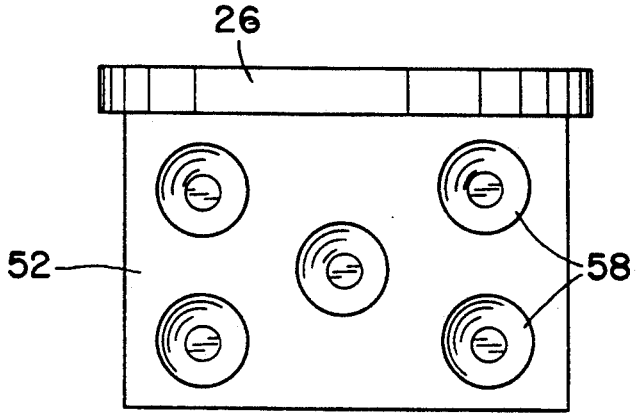
FIG. 20 is a rear view of the bottle emptying device of FIG. 14, wherein the rear plate has suction cups attached to its back surface.
Figure 21:
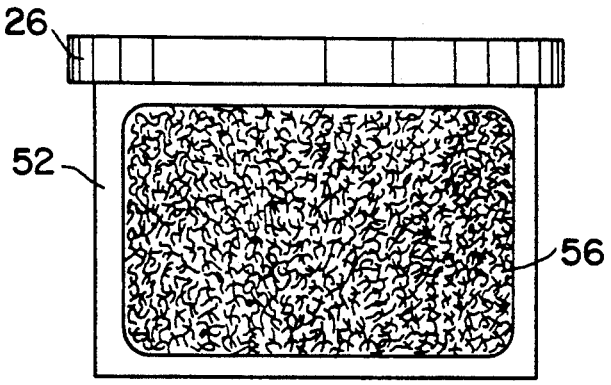
FIG. 21 is a rear view of the bottle emptying device of FIG. 14, wherein the rear plate has a Velcro pad attached to its back surface.

This embodiment is meant to be suspended onto a wall. FIGS. 20 and 21, both rear views of the device of FIG. 14, show two different mounting schemes. In FIG. 20, suction cups 58 have been attached to the back surface of the rear plate 52 of the device. These suction cups 58 may be attached to a glass or plastic surface contained on a wall, and the device thereby would be suspended. In FIG. 21, a Velcro pad 56 has been attached to the back surface of the rear plate 52 of the device. Just the same, the Velcro pad 56 could be meshed against a mating surface attached to a wall, and the device would again become suspended.

Figure 16:
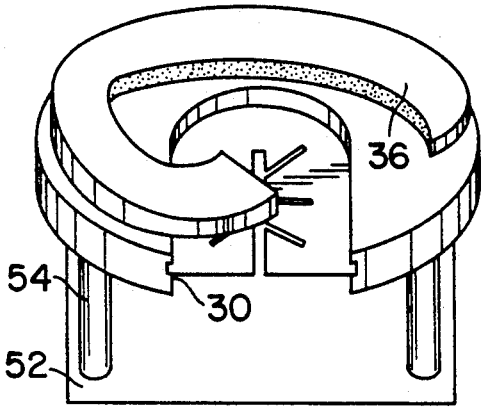
FIG. 16 is a front perspective view of the device for emptying bottles of FIG. 14, and including a rotating locking member.
Figure 17:
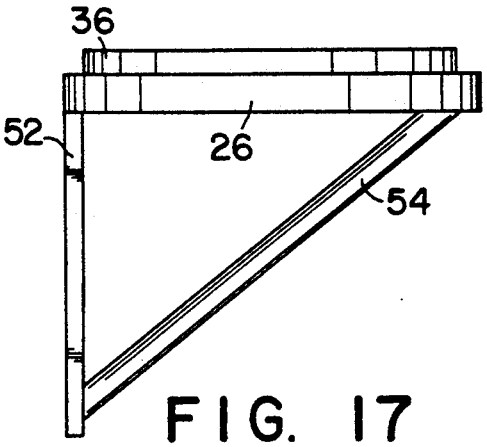
FIG. 17 is a left side view of the bottle emptying device of FIG. 16.
Figure 18:
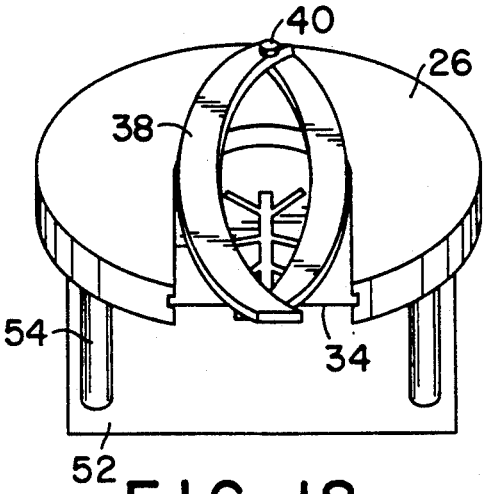
FIG. 18 is a front perspective view of the device for emptying bottles of FIG. 14, and including a scissoring locking mechanism.
Figure 19:
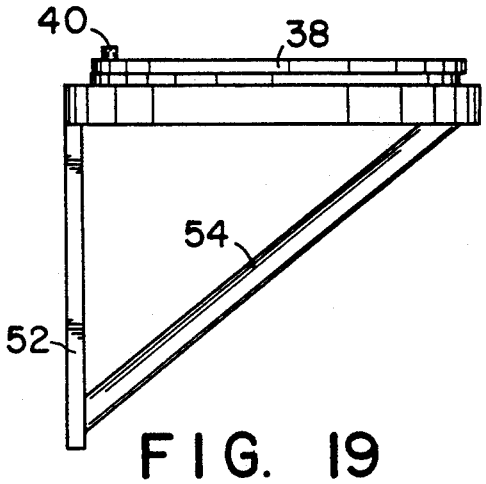
FIG. 19 is a left side view of the bottle emptying device of FIG. 18.

Essentially, the latter embodiment functions in the same manner as the former. Yet, the latter is perhaps more tailored to the bathroom of a house where shampoo bottles often require additional emptying. In operational use, the nearly empty bottle containing shampoo or the like would be inserted in to the rubber sleeve 34 of the device with its cap on. In this manner, the left over shampoo or the like would accumulate in the cap of the bottle and be available for immediate use. In order to provide additional lateral support, either a rotating locking member 36 or a scissoring locking mechanism could be incorporated as before. These are illustrated in FIGS. 16 and 18, respectively.

It should be clear that the invention is not limited to the details illustrated in the accompanying drawings, but may be subject to modifications falling within the spirit and scope of the invention. Therefore, without restricting the invention to the specific construction previously described, the invention shall cover all modifications falling within the scope of the appended claims.

What is claimed is:

1. A device for emptying bottles containing semi-viscous fluids, comprising, an upper member having a recess, a resiliently flexible sleeve contained within said recess of said upper member, a rear plate running perpendicular to said upper member and joined to said upper member along the rearward edge of said upper member, and a multiplicity of diagonal support members connecting said upper member to said rear plate, whereby said resiliently flexible sleeve may slide into a groove on said recess of said upper member, wherein said resiliently flexible sleeve has at least one slit cut along its length to allow the passage of the neck of an inverted bottle, and whereby said resiliently flexible sleeve is of sufficient strength to adequately hold said inverted bottle placed within said slit or group of slits to allow for gravity emptying of the contents of said inverted bottle.

2. A device for emptying bottles containing semi-viscous fluids as recited in claim 1, wherein said rear plate has a Velcro pad attached to its back surface, and whereby said Velcro pad serves as the means to suspend said device for emptying bottles to a wall.

3. A device for emptying bottles containing semi-viscous fluids as recited in claim 1, wherein said rear plate has a number of suction cups attached to its back surface, and whereby said suction cups serve as the means to suspend said device for emptying bottles to a wall.

4. A device for emptying bottles containing semi-viscous fluids, comprising, an upper member having a recess, a resiliently flexible sleeve contained within said recess of said upper member, a rear plate running perpendicular to said upper member and joined to said upper member along the rearward edge of said upper member, a multiplicity of diagonal support members connecting said upper member to said rear plate, and a rotating locking member joined to the top surface of said upper member, whereby said resiliently flexible sleeve may slide into a groove on said recess of said upper member, wherein said resiliently flexible sleeve has at least one slit cut along its length to allow the passage of the neck of an inverted bottle, whereby said resiliently flexible sleeve is of sufficient strength to adequately hold said inverted bottle placed within said slit or group of slits to allow for gravity emptying of the contents of said inverted bottle, wherein said rotating locking member rotates about to engage said inverted bottle placed within said resiliently flexible sleeve with its inner surface, and whereby the contact of said inner surface of said rotating locking member with said inverted bottle provides said inverted bottle with additional lateral support to prevent tipping.

5. A device for emptying bottles containing semi-viscous fluids as recited in claim 4, whereby said inner surface of said rotating locking member is soft and flexible.

6. A device for emptying bottles containing semi-viscous fluids, comprising, an upper member having a recess, a resiliently flexible sleeve contained within said recess of said upper member, a rear plate running perpendicular to said upper member and joined to said upper member along the rearward edge of said upper member, a multiplicity of diagonal support members connecting said upper member to said rear plate, and a scissoring locking mechanism joined to the top surface of said upper member, whereby said resiliently flexible sleeve may slide into a groove on said recess of said upper member, wherein said resiliently flexible sleeve has at least one slit cut along its length to allow the passage of the neck of an inverted bottle, whereby said resiliently flexible sleeve is of sufficient strength to adequately hold said inverted bottle placed within said slit or group of slits to allow for gravity emptying of the contents of said inverted bottle, wherein said scissoring locking mechanism comprises two inwardly curved blades joined to said upper member with a pin, wherein said inwardly curved blades of said scissoring locking mechanism may each pivot in a converging manner about said pin and engage said inverted bottle placed within said resiliently flexible sleeve with their inner surfaces, and whereby the contact of said inner surfaces of said inwardly curved blades with said inverted bottle provides said inverted bottle with additional lateral support to prevent tipping.

7. A device for emptying bottles containing semi-viscous fluids as recited in claim 6, whereby said inner surfaces of said inwardly curved blades of said scissoring locking mechanism are soft and flexible.

* * * * *